US007040262B2

(12) United States Patent
Ho

(10) Patent No.: US 7,040,262 B2
(45) Date of Patent: May 9, 2006

(54) EXPANSIBLE CHAMBER ENGINE WITH UNDULATING FLYWHEEL

(76) Inventor: Patrick C. Ho, 4 Quail Run, Hilton, NY (US) 14468

( * ) Notice: Subject to any disclaimer, the term of this patent is extended or adjusted under 35 U.S.C. 154(b) by 219 days.

(21) Appl. No.: 10/622,232

(22) Filed: Jul. 18, 2003

(65) Prior Publication Data

US 2004/0016412 A1 Jan. 29, 2004

Related U.S. Application Data

(63) Continuation-in-part of application No. 09/928,742, filed on Aug. 13, 2001, now Pat. No. 6,619,244.

(51) Int. Cl.
*F02B 75/18* (2006.01)

(52) U.S. Cl. ..... 123/56.1; 123/197.1; 123/54.3

(58) Field of Classification Search ..... 123/56.1, 123/56.2, 56.7, 56.8, 56.9, 54.3, 55.3, 197.1, 123/197.2

See application file for complete search history.

(56) References Cited

U.S. PATENT DOCUMENTS

| | | | |
|---|---|---|---|
| 3,570,459 A | 3/1971 | Combs | |
| 3,745,887 A | 7/1973 | Streigl | |
| 4,334,506 A | 6/1982 | Albert | |
| 5,894,763 A | 4/1999 | Peters | |
| 6,039,011 A | 3/2000 | Agalarov et al. | |
| 6,619,244 B1 * | 9/2003 | Ho | 123/56.1 |

* cited by examiner

*Primary Examiner*—Tony M. Argenbright
*Assistant Examiner*—Katrina Harris

(57) ABSTRACT

This engine relies on a flywheel having a flywheel axis and an undulating cam surface. A piston wit a roller at its base is positioned in a cylinder such that the roller abuts the undulating cam surface at some radial distance from the flywheel axis. Thus, as the piston is pushed downward by combustion pressure in the cylinder, it pushes against the cam surface causing the flywheel to rotate. As the flywheel continues to rotate its undulating surface pushes the piston back into position for a repetition of the cycle. The cam surface can be configured to control engine parameters such as compression ratio, duration of intake stroke, duration of exhaust stroke, duration of combustion stroke, duration of power stroke, compression stroke pattern, volumetric efficiency, or power stroke pattern.

21 Claims, 5 Drawing Sheets

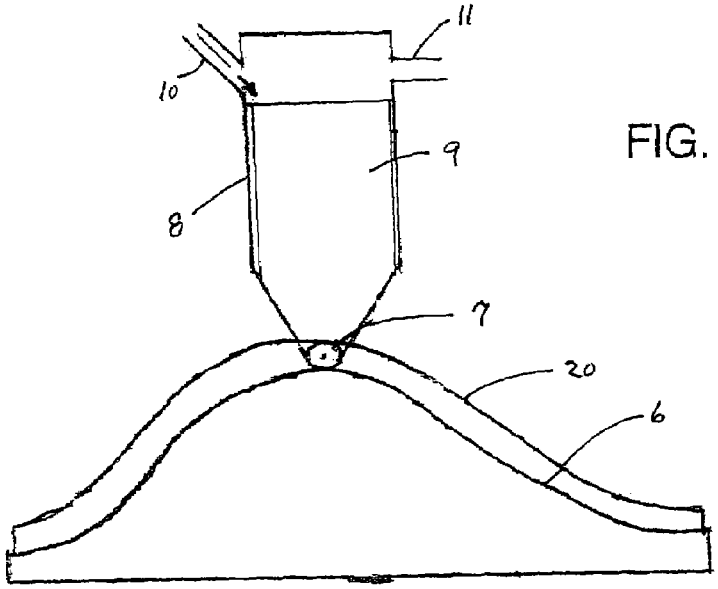
FIG. 9
FIG. 10
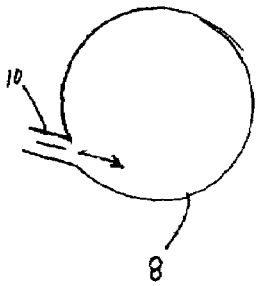
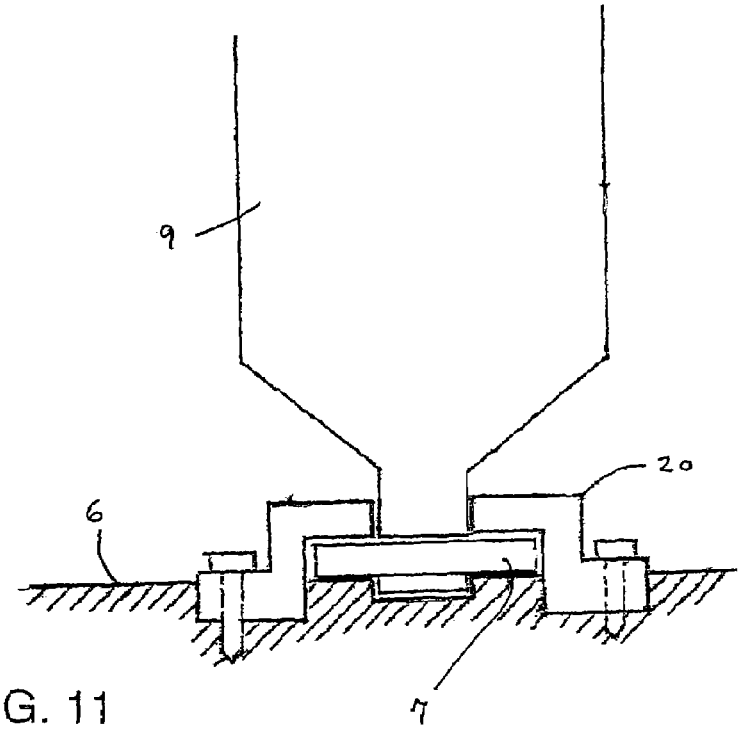
FIG. 11

EXPANSIBLE CHAMBER ENGINE WITH UNDULATING FLYWHEEL

RELATED APPLICATIONS

This application is a Continuation-In-Part of allowed parent application Ser. No. 09/928,742, filed Aug. 13, 2001 now U.S. Pat. No. 6,619,244, entitled Expansible Chamber Engine.

FIELD OF THE INVENTION

My invention relates generally to the field of reciprocating internal combustion engines. More specifically, it deals with an expansible chamber piston engine including an undulating flywheel.

BACKGROUND OF THE INVENTION

Reciprocating internal combustion engines include piston engines, rotary engines, and other well-known engine types. The specific field of this invention is, however, most directly to reciprocating piston engines.

In current engine designs of this type, a piston is used to drive a rotating crankshaft through a connection rod. The stroke of the rotating assembly is determined by the diameter of rotation of the crankshaft. This design leads to numerous limitations and deficiencies. First, at a given engine speed, the speed of the crankshaft ends remain constant. Thus, the duration of intake strokes, exhaust strokes, compression strokes and power strokes must remain the same. Second, power is produced by filling the engine cylinder with an air fuel mixture and inducing combustion of the mixture to generate heat and expansion to propel the pistons and, thereby, the crankshaft. Filling the cylinder with an air fuel mixture takes time. Power produced has, therefore, a direct correlation to the volumetric efficiency of the intake cycle. However, the time for the intake cycle is fixed by the rotational speed of the crankshaft and volumetric efficiency is often compromised. Third, completing the combustion process also takes time. In conventional engine designs, in order to compensate for the time it takes for complete combustion, the ignition timing is advanced ahead of the piston moving to top dead center (TDC) during a compression stroke. The higher the speed of rotation, the more advance in timing is required. This, in turn, wastes energy since additional energy must be expended in using the piston (during the compression stroke) to compress the expanding gases produced during the onset of the combustion process. This is completely wasted energy that could have been used to propel the crankshaft. Fourth, a method commonly used to compensate for the need for additional ignition time is to lengthen the connecting rod, thereby allowing the piston to "park" at top dead center for longer. However, there is a limitation to the length of the connecting rod used since longer rods will expand the physical size of the engine. Fifth, the power output of the convention engine design is directly proportional to the work generated by the expansion of the combusted fuel and air mixture. Since the time for the power stroke to transfer power to the crankshaft is dictated by the rotational speed, unused heat and expansible energy are channeled out when the exhaust valve opens near the end of the power stroke as the piston approaches bottom dead center.

Based on the foregoing, it is clear that there is a great need for additional flexibility in designing the pattern, speed and timing for various strokes in piston based internal combustion engines. However, there has been almost nothing done that is relevant to this goal. Moreover, there is no prior art where a piston interacts directly with an undulating flywheel surface. Only one patent known to the inventor might be argued to bear some relationship to an engine of this type: U.S. Pat. No. 3,745,887 issued to Striegl in 1973. Streigl has pistons that interact with a hollow cylindrical "rotor" having a cam edge. Each piston of the Striegl device is nested in its own individual hollow rotor with each rotor connected by an output/drive shaft to a flywheel. All of these elements are in axial alignment. However, there is nothing in Streigl or any other prior art known to the inventor that has off-axis pistons interacting with the undulating surface of a flywheel. Nor, does Streigl provide the additional design flexibility necessary for the truly efficient functioning of piston based internal combustion engines.

SUMMARY OF THE INVENTION

My invention is a new form of expansible chamber engine intended primarily for use as an internal combustion engine. Its characteristic features are, however, also applicable to use with steam.

The engine of my invention includes a rotatable flywheel with an undulating cam surface, and an expansible chamber device including a piston abutting the cam surface and movable in a cycle between retracted and extended positions. The cycle includes a power stroke of the piston from its retracted to its extended position to urge the piston against the cam surface and thereby rotate the flywheel, and a compression stroke from the extended position to the retracted position in response to the cam surface. This arrangement offers numerous advantages, including several advantages inherent in the use of an undulating cam surface and, likewise, several advantages inherent in its use of an expansible chamber device interacting with this surface.

Many of the primary advantages of the undulating cam surface of my invention derive from the fact that it can be shaped and formed so as to provide engine cycle features desired by the designer. Thus, it provides the designer with extraordinary flexibility in adjusting the duration of the intake/exhaust cycle, the duration of the combustion/power cycle, the compression stroke pattern (so as to maximize cylinder fill volumetric efficiency), and the power stroke pattern (so as to maximize transfer of power from the piston the fly wheel). In comparison, the conventional crankshaft, piston, and connecting rod rotational assembly provide almost no design flexibility. In the conventional assembly, the radius of the crankshaft and piston fixes rotational duration. And, TDC (top dead center) and BDC (bottom dead center) duration can be only minimally altered through the use of difference lengths of connecting rod at a given crankshaft rotational radius.

The use of an expansible chamber also provides numerous advantages. To begin with, it serves to reduce the weight of my engine's reciprocating assemblies by eliminating connecting rods, eliminating crankshaft and counterweights, and reducing the number of cylinders for the same number of power stroke per flywheel revolution. In addition, since the top of the two pistons in each expansible chamber form the combustion chamber at their top dead center, it offers flexibility in designing the shape of the combustion chamber to allow the most efficient flame front propagation. This in turn promotes complete and efficient combustion to yield maximum combustion pressure. It also allows dynamic compression pressure to be varied by adjusting intake pressure and/or cam profile. Further, it allows flexibility in the positioning of the intake port and exhaust ports (thereby promoting more effective discharge of exhaust gas, influx of incoming air and tumbling and turbulence inside the cylinder). The large surface areas it makes available also provide flexibility in the positioning of sparkplug and/or fuel injector in relation to the combustion chamber (for the best flame travel and efficient and completion combustion of fuel). In comparison, operation of a conventional (and complex) crankshaft, piston, connecting rod rotational assembly requires constant acceleration and deceleration of its of pistons and connecting rods. Thus, much of the energy produced from the power stroke of one cylinder is consumed in propelling and decelerating the dead weight of other reciprocating units. Also, the small amount of area available in the cylinder head and combustion chamber of conventional assemblies limits the positioning of intake valve, exhaust valve, spark plug and/or fuel injector.

BRIEF DESCRIPTION OF DRAWINGS

FIG. 1 is a side view, partly in section, of an engine according to this invention.

FIG. 2 is a view similar to FIG. 1, showing engine pistons in different positions.

FIG. 3 is a pictorial view of the engine of FIGS. 1, 2, as seen from upper right.

FIGS. 4A through 7 provide schematic cam surface profiles indicative of the surface configuration at a particular radius from the central axis of a flywheel. Thus, a distance along the X-axis shown in these drawings is equal to a particular circumferential arc length at said radius.

FIG. 4A provides a schematic first undulating surface/cam roller cross-section providing one stroke pattern.

FIG. 5 provides a schematic undulating surface/cam roller cross-section where the undulating surface has a flattened trough.

FIG. 6 provides a schematic undulating surface/cam roller cross-section where the undulating surface has a flattened and stepped trough.

FIG. 7 provides a schematic undulating surface/cam roller cross-section where the undulating surface has a flattened and stepped trough, an extended ascent or compression stroke surface and a shortened descent or expansion stroke surface.

FIGS. 8 through 11 illustrate additional modifications, particularly those relevant to four-stroke engines.

FIG. 8 provides a schematic illustration of a configuration having a single flywheel with expansible chambers on either side thereof.

FIG. 9 provides a schematic side view of a configuration having a retaining rail to maintain a cam roller on a cam surface.

FIG. 10 provides a schematic view from above of the cylinder illustrated in FIG. 9.

FIG. 11 provides a more detailed cross-sectional schematic view of, particularly, the retaining rails of the configuration illustrated in FIG. 9.

DETAILED DESCRIPTION

Figure 1:
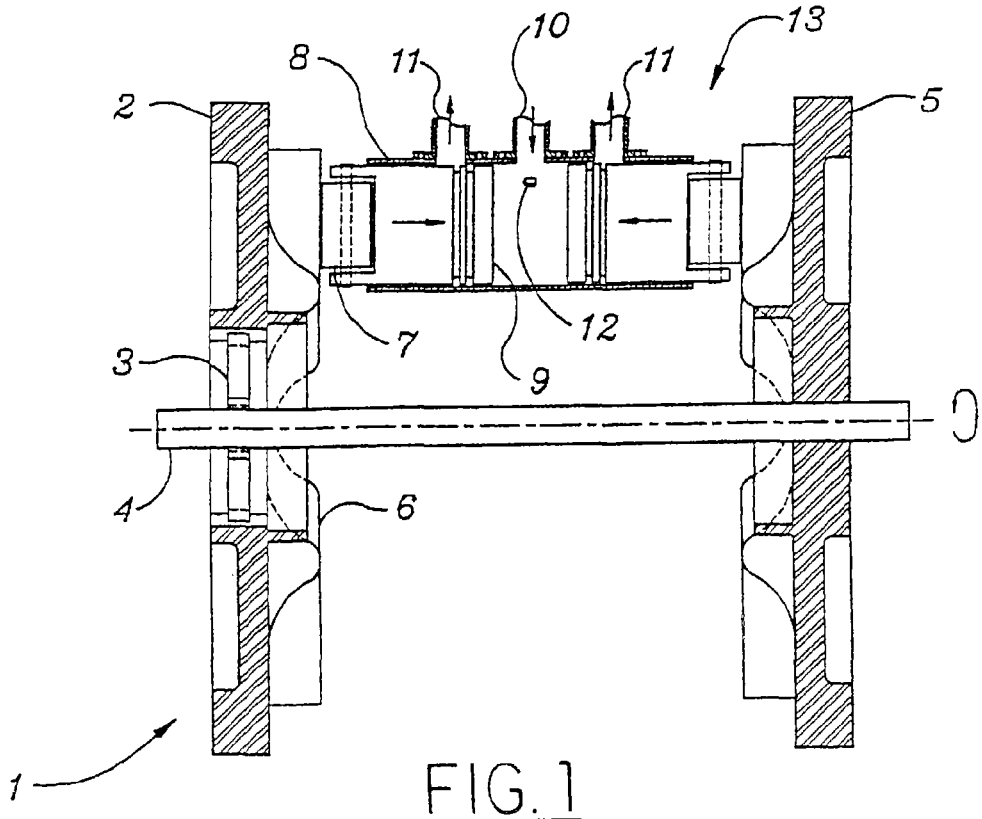
FIGS. 1 through 3 provide basic sectional and perspective views of a preferred embodiment of my invention.
Figure 2:
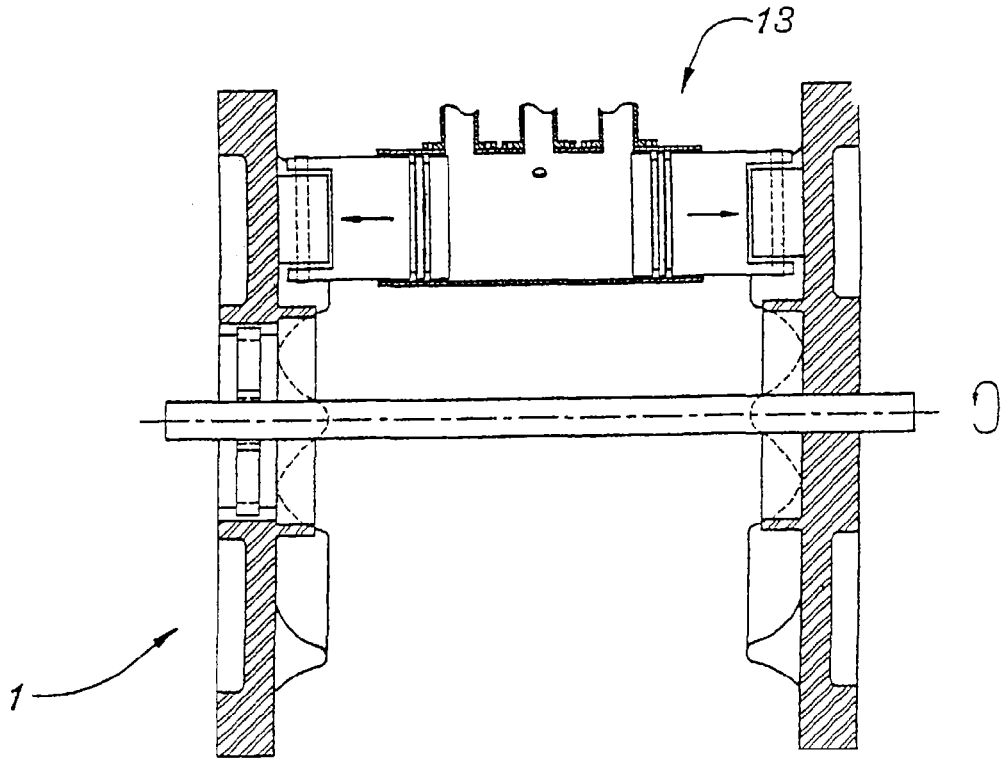
Figure 3:
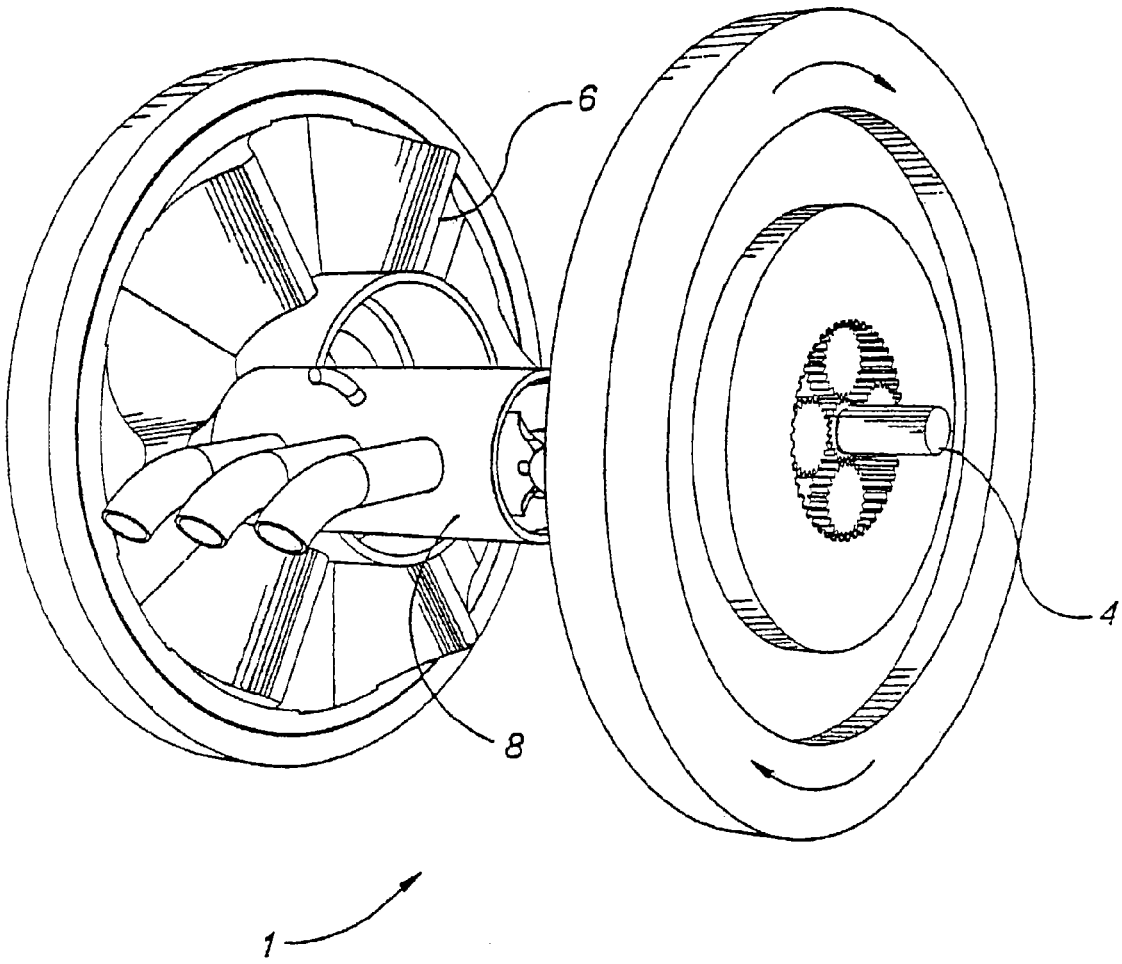

Referring to the drawing, the preferred embodiments of my engine include left and right flywheels 2, 5 on an output shaft 4, and an expansible chamber device 13 between the flywheels, radially offset relative to the shaft 4. The expansible chamber device 13 includes a cylinder 8 with left and right pistons 9 movable in the cylinder between retracted positions (FIG. 1) and extended positions (FIG. 2). The cylinder 8 includes an air inlet port 10, left and right exhaust ports 11, and a fuel inlet port 12. For two-stroke applications, exhaust ports 11 would be positioned as shown, while for four-stroke applications they would be located near the center like ports 10, 12. For gasoline application the port 12 is for both fuel injector and spark plug. For diesel application the port 12 is for fuel only. Each piston 9 includes a cam roller 7 on its outboard end. Left flywheel 2 is connected to the output shaft 4 by a planetary gear system 3. The inner face of the flywheel 2 includes a cam surface 6. The right flywheel 5 is fixed to the output shaft 4, but is otherwise the same as the left flywheel 2. The cam surface 6 is of a wavy or rolling (e.g. sinusoidal) configuration, as best shown in FIG. 3.

Figure 8:
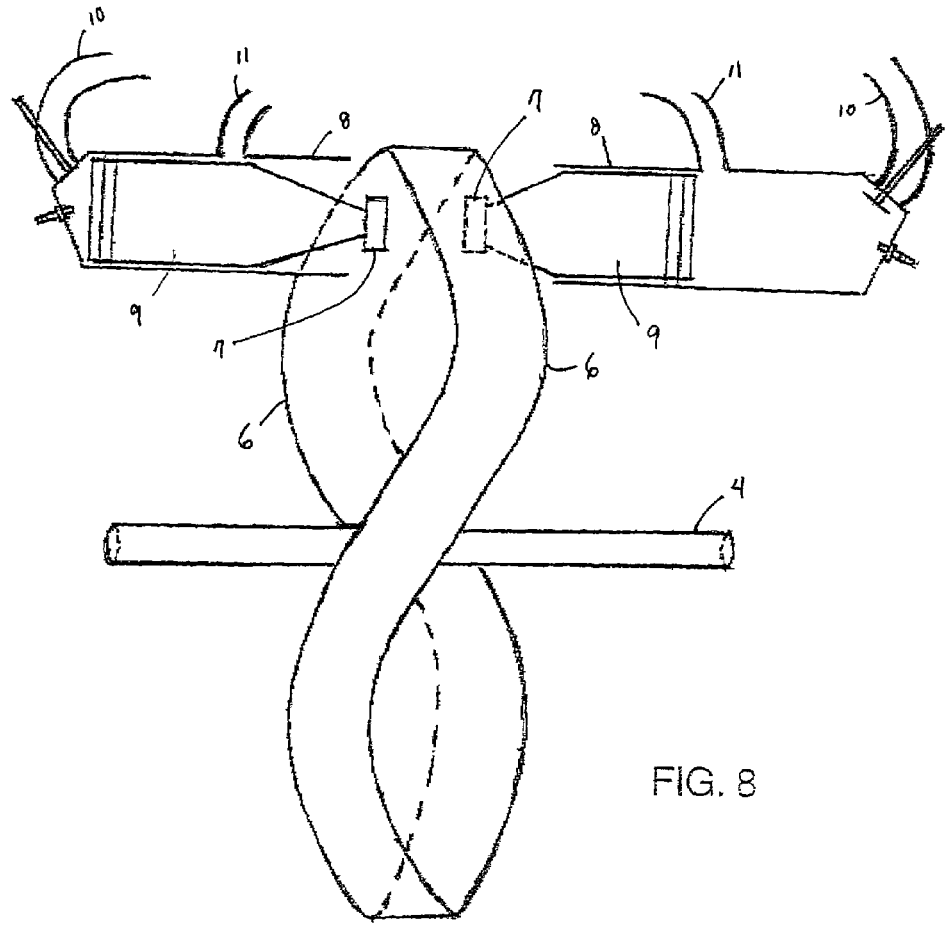

Notwithstanding the foregoing description of a preferred embodiment, it should be realized that my invention could also be structured with a single piston in an expansible chamber interacting with a single flywheel and undulating cam surface. This configuration is, in effect, illustrated by taking either side of FIGS. 1 through 3 in isolation from the other. It could also be structured with single piston expansible chambers on opposite sides of a single flywheel with undulating cam surfaces on either side of said flywheel. (See, FIG. 8). This configuration is, in effect, also illustrated by taking either side of FIGS. 1 through 3 in isolation from the other as being an illustration of only one side of a flywheel with the other side being identical. However, the embodiment illustrated is FIGS. 1 through 3 is considered to be the preferred embodiment.

The overall operation of my invention can best be understood by considering the configuration illustrated in use as a two-stoke engine. In this application, FIG. 1 could be considered to show pistons 9 at the "top" of their compression strokes. When the pistons are at or near this "top" position, combustion in the cylinder 8 drives the pistons apart in power strokes to their "bottom" positions shown in FIG. 2. The cam rollers 7 push against their respective cam surfaces 6. The wavy cam surfaces 6, which are inclined relative to the axial thrust of the cam rollers 7, react to the cam rollers to rotate the flywheels 2, 5, and output shaft 4. In the power/exhaust stroke, combustion gas is exhausted through exhaust ports 11. In the intake/compression stroke, air is forced into the cylinder through intake port 10 by positive charging means such as a compressor or supercharger (not shown). During the intake/compression stroke, cam surfaces 6 drive the cam rollers 7 and pistons 9 inward. In other words, the cams 6 and rollers 7 are acting in the normal cam/follower relationship. During the power/exhaust stroke of the engine cycle, the relationship is inverted. The piston-driven cam rollers 7 act against the cam surfaces 6 to drive their respective flywheels. (In spite of this inversion of functions during half of the engine cycle, it will nevertheless be convenient to consistently identify members 6 and 7 as "cam surface" and "cam roller" respectively.) Flywheels 2, 5 rotate in opposite directions to give the engine balance and smooth operation. One flywheel 5 is connected directly to the output shaft 4, while the other flywheel 2 is connected to the shaft 4 by a planetary gear system 3. Thus, while the flywheels turn in opposite directions, they act in the same direction on the output shaft.

As previously noted, there are several advantages to be realized from the engine of this invention:

First, the engine has no crankshaft or connecting rods, so the dynamic loads and stresses associated with such rapidly accelerating, decelerating, rotating, and reciprocating members are eliminated. Fewer rotating and reciprocating parts also reduces friction losses. The engine is also lighter in weight because of fewer components, and because reduced internal antagonistic forces allow for lighter construction.

Figure 4A:
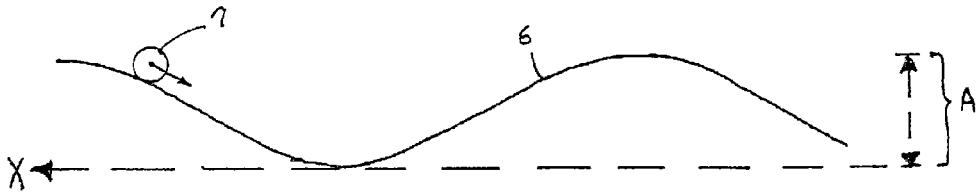

Second, the cam surface configuration can be designed to vary or control numerous parameters. Thus, by way of example, FIG. 4A illustrates a sinusoidal wave pattern (with an amplitude A) characterizing the undulating cam surfaces 6 of my invention at a particular radius "R" from the center of flywheels 2, 5. (An arrow on the X axis line and one extending from the center of cam roller 7 indicate the directions of movement of, respectively, cam surface 6 and cam roller 7 in relation to each other.) As will be noted in moving next to FIG. 4B, the amplitude A' of the wave pattern can easily be increased to increase the compression ratio (and piston travel/stroke) of my invention. Moreover, this change can be effected in either of two ways: (a) by changing a flywheel to one with a different pattern; or (b) by varying the sinusoidal wave pattern at different radii of the same flywheel. Thus, in keeping with the second alternative, FIG. 4A can be considered as representative of the wave pattern at a first radius R while FIG. 4B can be considered as representative of that pattern at a second radius R'. In this situation, the stroke and compression can be varied, as discussed in more detail below, by radial movement of an expansible chamber 13 with respect to a flywheel 2, 5.

Figure 4B:
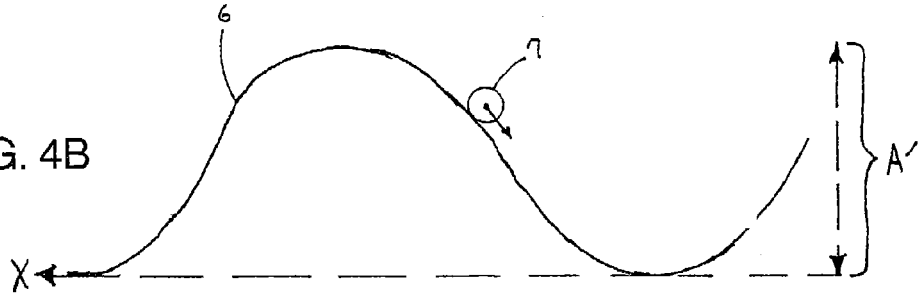
FIG. 4B provides a schematic second undulating surface/cam roller cross-section providing a second stroke pattern.
Figure 5:
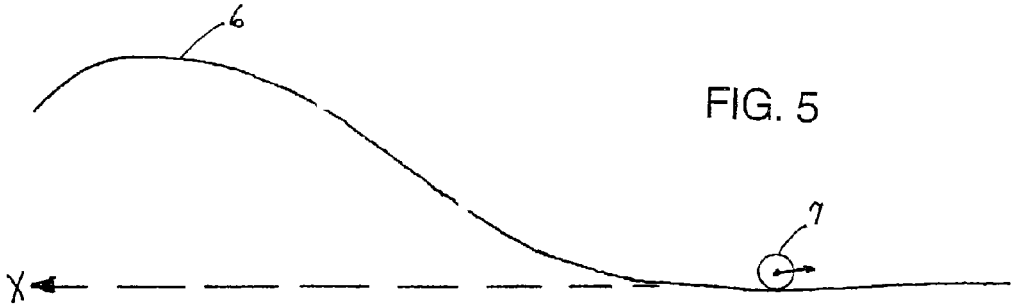
Figure 6:
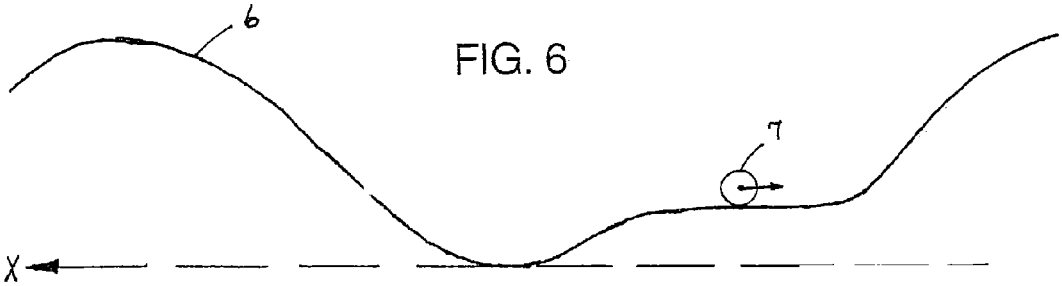
Figure 7:
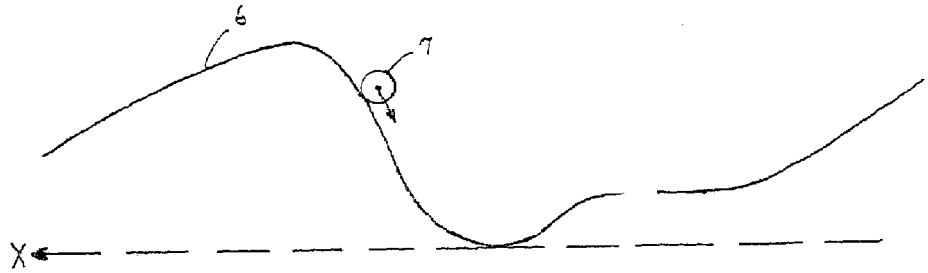

The foregoing by no means exhausts the possibilities in this area. The undulating cam surface 6 of flywheels 2, 5 need not be strictly symmetrical and sinusoidal as illustrated in FIGS. 4A and 4B. For example, FIG. 5 illustrates a configuration having a flattened trough. In this configuration, the bottom of the trough would correspond to the position of the pistons illustrated in FIG. 2 where exhaust ports 11 are exposed. Thus, this configuration provides an extended period of time with pistons 9 in the lowest position in order to maximize the purging of expansible chamber 13 of exhaust. (And, increasing or decreasing the arc length of a portion of undulating cam surface 6 will, correspondingly, increase or decrease the duration of an event in the engine cycle related to an engine parameter.) In contrast to FIG. 5, FIG. 6 illustrates a stepped trough. In this configuration the lowest portion of the trough allows exhaust to escape via exhaust ports 11 while the next step upward provides an extended period for the injection and mixing of air and fuel prior to the beginning of a compression stroke. Moreover, the upper portions of the curves illustrated in FIGS. 4 through 6 need not take the strictly symmetrical form illustrated in these figures. FIG. 7 illustrates a variation of FIG. 6 where the compression stroke is longer than the power stroke. It should also be remembered that any or all of the foregoing variations based on changing undulating surface 6 (as previously discussed only with respect to FIGS. 4A and 4B) can vary gradually with the radius of flywheels 2, 5. In this way, all of the features illustrated in FIGS. 4A through 7 can be made to vary by moving expansible chamber(s) 13 some radial distance and thereby changing the radial position of expansible chamber(s) 13 with respect to flywheels 2, 5.

Thus, numerous variations to the undulating surfaces 6 of my invention are possible that can alter compression ratios, duration of intake/exhaust stroke, duration of combustion/power stroke, compression stroke pattern. (to maximize cylinder fill volumetric efficiency), and power stroke pattern to maximize transfer of power from piston to flywheel. Overall, the amplitude of a stroke is based on crest to trough amplitude, while the length of time allowed for any event in the engine cycle is related to the slope of the portion of the undulating surface corresponding to the event. A steeper slope dictates a shorter time, while a flatter or flat slope extends the time. The aforesaid ability to freely vary, shape and determine various engine performance parameters stands in stark contrast to conventional crankshaft-piston-connecting rod assemblies. In these assemblies rotational duration is fixed by the radius of the crankshaft, and piston TDC and BDC duration can be only minimally altered by use of connecting rods of different lengths.

Third, the expansible chamber itself can also be designed and configured to enhance certain characteristics. As previously noted, my expansible chamber engine reduces the weight of the reciprocating assemblies by eliminating connecting rods, crankshaft, and counterweights, and with fewer cylinders for a given number of power strokes per flywheel revolution. However, this is only part of the advantages it offers. As the tops of the two pistons form the combustion chamber at their top dead center, my design provides enormous flexibility in designing the shape of the combustion chamber for complete and efficient combustion, flame propagation, and maximum combustion pressure. For example, in conventional engines external components affect the shape the combustion chamber can take and the small space in the cylinder head and combustion chamber limits the positioning of intake and exhaust valves, spark plug, and/or fuel injector. In my engine, the top and bottom of the combustion chamber is formed by the tops of pistons 9. The sides of the combustion chamber are formed by the arcing walls of cylinder 8. Thus, in contrast to the asymmetrical wedge shape typical of most conventional combustion chambers, my invention begins with a symmetrical chamber. The top and bottom of this chamber, formed by the tops of pistons 9, can easily be formed into the hollow hemispherical shape favored for flame front propagation. Likewise, the broad arcing walls of cylinder 8 provide ample room for the placement of one or several air inlet ports 10, fuel inlet ports 12, and/or sparkplugs as necessary or advisable to maximize combustion (and thereby maximize power while minimizing pollution).

Intake and exhaust ports can also be located to enhance the discharge of exhaust gas, influx of incoming air, and tumbling and turbulence within the cylinder. For example, in FIGS. 9 and 10, inlet air port 10 is located at the top of cylinder 8 is canted with respect to the vertical axis of the cylinder 8 so as to maximize tumbling. It is also horizontally canted with respect to a radius of cylinder 8 (entering cylinder 8 tangentially) so as to maximize turbulence. Sparkplug(s) and/or fuel injector(s) can, likewise, be positioned in relation to the combustion chamber for complete and efficient combustion and flame propagation.

Fourth, the drawing shows only one cylinder, as an example. Plural cylinders and, therefore, plural power strokes can be added without addition of size. The number of power strokes per revolution is a function of the number of cylinders included, and also of the number of peaks and troughs on the cam surface.

Fifth, The radially offset position of the cylinder relative to the output shaft can be altered to thereby alter the speed of revolution, torque, and horsepower output characteristic of the engine 1 even where other cam surface features remain constant. For example, a flatter torque curve can be achieved by moving the cylinder radially toward or away from the output shaft in relation to the rpm, thereby producing wider power range and requiring fewer gears in transmission.

Sixth, deviation of angle of the cylinder axis in relation to the output shaft allows the outward push of the piston, during the power stroke, to exert more force on the cam surface and flywheel. This, in turn, allows my engine to produce more power at a given amount of combustion pressure in comparison to conventional engine design. Further, this change will reduce frictional forces between the sides of the cylinder 8 and the sides or skirt of piston 9, thereby reducing friction and wear and tear on these parts. An angle in the range of 20° to 30° is considered optimal.

Seventh, power transmission from a power stroke exerting force on opposing flywheels 2, 5 rotating in opposite directions eliminates or reduces vibration, for a smooth running of the engine 1. The engine 1 can idle at lower rpm because less energy is required to rotate the flywheel and the reciprocating assemblies and less internal friction to overcome.

Eighth, my engine 1 is more fuel-efficient and produces less waste heat for a given amount of power output in comparison to conventional engines. This is because less energy is required to rotate the flywheels 2, 5 and the reciprocating piston assemblies of an expansible chamber 13, and because more of the combustion pressure is applied to rotating the flywheels 2, 5 for power output. The simple drive train of my invention eliminates parasitic power losses from friction, opposing inertia from large reciprocating masses, camshaft, and valve train, thereby yielding more usable output power.

Finally, my engine 1 is compact because of the radial arrangement of plural cylinders around the output shaft and can be easily adapted for both two-stroke and four-stroke applications. Two-stroke applications have been previously discussed. Four-stroke applications require only minimal adaptations. Thus, as previously noted and illustrated in FIG. 9, exhaust outlet 11 should be moved close to the head of cylinder 8 and/or the center of a dual piston expansible chamber of the type illustrated in FIGS. 1 through 3. In addition, means must be provided to maintain cam roller 7 in contact with undulating cam surface 6 during intake strokes. A solution to this problem is illustrated in FIGS. 9 and 11. In these drawing figures, a retaining rail is provided for this purpose.

In summary, my engine presents a unique and valuable addition to the field of internal combustion engines and offers unique flexibility and advantages in engine design as well as engine cycle design. The foregoing description of a preferred embodiment of my invention sets forth the best mode presently contemplated for carrying out my invention. However, any details as to materials, quantities, dimensions, and the like are intended as illustrative. The concept and scope of my invention are limited not by the description but only by the following claims and equivalents thereof. Moreover, any terms indicative of orientation are used with reference to drawing illustrations. Such terms are not intended as limitations but as descriptive words. Apparatus described herein retains its described character whether it is oriented as shown or otherwise.

Parts List

1 Engine
2 Left flywheel
3 planetary gear system
4 Output shaft
5 Right flywheel
6 Cam surface
7 Cam roller
8 Cylinder
9 Piston
10 Air inlet port
11 Exhaust port
12 Fuel inlet port
13 Expansible chamber device
20 Retaining rail

I claim:

1. An engine, including:

a rotatable flywheel having a flywheel axis and including an undulating cam surface;

an expansible chamber device including a piston having a central axis radially spaced from said flywheel axis, said piston abutting said cam surface and movable in a cycle between retracted and extended positions;

said cycle including a power stoke from said retracted position to said extended position to urge said piston against said cam surface to thereby rotate said flywheel, and a compression stroke from said extended position to said retracted position in response to said cam surface; and a portion of said undulating cam surface at a certain radius is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

2. An engine as defined in claim 1, wherein amplitude of a portion of said undulating cam surface at a certain radius is selected to control an engine parameter.

3. An engine as defined in claim 1, wherein amplitude of a portion of said undulating cam surface at a certain radius is selected to control a length of piston travel within said expansible chamber for said portion.

4. An engine as defined in claim 1, wherein arc length of a portion of said undulating cam surface at a certain radius is selected to control an engine parameter.

5. An engine as defined in claim 1, wherein arc length of a portion of said undulating cam surface at a certain radius is selected to control duration of an event related to an engine parameter.

6. An engine as defined in claim 1, wherein amplitude and arc length of a portion of said undulating cam surface at a certain radius are selected to control at least one engine parameter.

7. An engine as defined in claim 1, wherein amplitude and arc length of a portion of said undulating cam surface at a certain radius are selected to control at least one engine parameter for said portion.

8. An engine as defined in claim 1, wherein the expansible chamber device is radially moveable relative to said flywheel axis.

9. An engine as defined in claim 8, wherein radial movement of said expansible chamber with respect to said flywheel axis will vary at least one engine parameter.

10. An engine as defined in claim 9, wherein amplitude and arc length of a portion of said undulating cam surface do not vary radially.

11. An engine as defined in claim 9, wherein amplitude and arc length of a portion of said undulating cam surface vary radially.

12. An engine as defined in claim 9, wherein a distance of radial movement is selected to control at least one engine parameter.

13. An engine as defined in claim 1, wherein the central axis is angled with respect to said flywheel axis so as to cause the piston to exert more force on the cam surface during a power stroke.

14. An engine as defined in claim 1, wherein said cycle further includes an intake stroke from said retracted position to said extended position in response to said cam surface and an exhaust stroke from said extended position to said retracted position in response to said cam surface.

15. An engine as defined in claim 1, wherein said piston is connected to said cam surface while remaining moveable along the cam surface.

16. An engine as defined in claim 1, wherein said piston includes on the outboard end thereof a cam roller for engagement with said cam surface.

17. An engine as defined in claim 16, further comprising a retaining rail to maintain said cam roller in engagement with said cam surface while remaining moveable along said cam surface.

18. An engine as described in claim 1, further comprising:

an other undulating cam surface on an opposite face of said flywheel, said other undulating cam surface having an other expansible chamber device including an other piston having a central axis radially spaced from said flywheel axis, said other piston abutting said other cam surface and movable in a cycle between retracted and extended positions including a power stroke from said retracted position to said extended position to urge said other piston against said other cam surface to thereby rotate said flywheel, and a compression stroke from said extended position to said retracted position in response to said other cam surface; and at least one of said cam surfaces is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

19. An engine, including:

first and second coaxial and axially spaced flywheels operatively connected to a coaxial output shaft and including respectively first and second undulating cam surfaces facing each other; and an expansible chamber device disposed between said flywheels and radially offset relative to said output shaft, said expansible chamber device inducting first and second opposed pistons movable in a cylinder between retracted and extended positions, said pistons adapted for engagement with respectively said first and second cam surfaces;

said pistons operating in cycles including power strokes from said retracted positions to said extended positions to urge said pistons against respective cam surfaces to thereby rotate corresponding flywheels, and compression strokes from said extended positions to said retracted positions in response to said cam surfaces; and a portion of at least one of said undulating cam surfaces at a certain radius is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

20. An engine as defined in claim 16, wherein one of said flywheels is directly connected to said output shaft for rotation therewith, and the other of said flywheels is operatively connected to said output shaft for rotation in the opposite direction of rotation.

21. An engine, including:

first and second coaxial and axially spaced flywheels operatively connected to a coaxial output shaft and respectively including first and second undulating cam surfaces facing each other with one of said flywheels being directly connected to said output shaft for rotation therewith, and the other of said flywheels being operatively connected to said output shaft for rotation in the opposite direction of rotation; and an expansible chamber device disposed between said flywheels and radially offset relative to said output shaft, said expansible chamber device including a stationary cylinder with air inlet, fuel inlet, and exhaust ports, and first and second opposed pistons movable in said cylinder in opposite directions between retracted positions and extended positions, said pistons each including on the outboard end thereof a cam roller for engagement with a corresponding one of said cam surfaces;

said pistons operating in cycles including power strokes from said retracted positions to said extended positions, and compression strokes from said extended positions to said retracted positions;

said power strokes urging said cam rollers of said first and second pistons against respectively said first and second cam surfaces to thereby rotate said first and second flywheels;

said compression strokes responsive to action of said first and second cam surfaces against said cam rollers of respectively said first and second pistons to move said pistons to said retracted positions; and at least one of said cam surfaces is configured to control at least one engine parameter, including at least one of a compression ratio, a duration of intake stroke, a duration of exhaust stroke, a duration of combustion stroke, a duration of power stroke, a compression stroke pattern, a volumetric efficiency, and a power stroke pattern.

* * * * *